US007779519B2

(12) United States Patent
Ashwood, Jr.

(10) Patent No.: US 7,779,519 B2
(45) Date of Patent: Aug. 24, 2010

(54) ACCESSORY FOR SHOELACES

(76) Inventor: Henry L. Ashwood, Jr., 2858 Pallanza Dr., St. Petersburg, FL (US) 33705

( * ) Notice: Subject to any disclaimer, the term of this patent is extended or adjusted under 35 U.S.C. 154(b) by 0 days.

(21) Appl. No.: 11/485,924

(22) Filed: Jul. 12, 2006

(65) Prior Publication Data

US 2006/0248694 A1 Nov. 9, 2006

Related U.S. Application Data

(63) Continuation-in-part of application No. 10/772,618, filed on Feb. 6, 2004, now abandoned.

(51) Int. Cl.
*A43C 7/00* (2006.01)

(52) U.S. Cl. ..... 24/712.3; 24/712.5; 24/712.1

(58) Field of Classification Search ..... 24/712.1, 24/712.2, 712.3, 712.5, 712.4; 36/50.1
See application file for complete search history.

(56) References Cited

U.S. PATENT DOCUMENTS 948,460 A * 2/1910 Partridge ..... 24/712.6
3,122,805 A * 3/1964 Hakim ..... 24/712.3
3,176,362 A * 4/1965 Tames ..... 24/712.2
3,229,340 A * 1/1966 Herdman ..... 24/712.3
3,473,198 A * 10/1969 Meier ..... 24/712.3
3,908,238 A * 9/1975 Panicci ..... 24/712.3
4,553,293 A * 11/1985 Blum ..... 24/712.2
5,022,127 A * 6/1991 Ang ..... 24/712.2
5,918,352 A * 7/1999 Galbreath ..... 24/712.3
6,014,080 A * 1/2000 Layson, Jr. ..... 340/573.1
6,256,399 B1 * 7/2001 Poor ..... 382/100
6,988,298 B2 * 1/2006 Ternasky et al. ..... 24/712.3
2002/0020046 A1 * 2/2002 Voughlohn ..... 24/712.1
2005/0172463 A1 * 8/2005 Rolla ..... 24/712.1

* cited by examiner

*Primary Examiner*—Robert J Sandy

(57) ABSTRACT

A device for securing shoelaces that includes a member for encapsulating free ends of a shoelace, the member has a pair of openings positioned within a rear wall of the member. Further, a reinforcement area is included along the rear wall of the member. A slit is extended along the length of the top part of the member. Lastly, a shoelace storage compartment formed within the member and receives the free ends of the shoe lace after one of each of the free ends has passed through at least one of the pair of openings.

1 Claim, 10 Drawing Sheets

ACCESSORY FOR SHOELACES

RELATED APPLICATIONS

This application is a continuation-in-part of U.S. patent application Ser. No. 10/772,618 filed Feb. 6, 2004, now abandoned entitled "ACCESSORY FOR SHOELACES," the disclosure of which is incorporated herein by reference.

BACKGROUND OF THE INVENTION

1. Field of the Invention

The present invention relates to an accessory for shoelaces and more particularly pertains to a cover means for collecting and storing the bows and ends of tied shoelaces while being attached to the shoes.

2. Description of the Related Art

The use of separate fastening devices for shoes, shoelace tying devices and shoelace holders is known in the prior art. More specifically, shoelace holders heretofore devised and utilized for the purpose of holding the shoelace bow and/or end of the shoelace are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,999,888, which discloses a shoelace retainer that includes a flexible, elongated strap member that has a plurality of hook fastener elements on one surface thereof and a plurality of complementary loop fastener elements on an opposite surface thereof. Included is a tab member with an elongated slot disposed at a first end of the strap member for attaching the strap member to the footwear. The free ends of the shoelace are passed through the slot and the ends are tied in a conventional bowknot. The bow loops and free ends of the shoelace are placed on top of the strap member and the strap member is rolled up and onto itself, whereby the hook fastener elements become interlocked with the loop fastener elements, thereby confining the bow loops and free ends between convoluted layers.

Further, there are numerous other patents granted in the field of accessories for shoelaces. Such as U.S. Pat. Nos. 4,553,293, 4,949,437, 5,335,400, 5,657,557, 6,000,111, 6,601,323, and U.S. Patent Design Nos. 369,237 and 356, 675. Other such patents are:

In U.S. Pat. No. 4,553,293 the invention does secure the laces but it does not provide a collecting and storage for the bows and ends of shoe laces.

In U.S. Pat. No. 4,949,437 the invention does secure the shoe laces but allows the bow and ends of the laces to flop.

In U.S. Pat. No. 5,335,400 the invention does provide a collection and storage means but does not prevent the accessory from flopping around.

In U.S. Pat. No. 5,657,557 the invention attaches to both the eyes and is secured to the back of the shoe. The loose ends of the shoelaces flop around.

In U.S. Pat. No. 6,000,111 the invention does provide a shoelace containment factor. In this invention the fastener is attached to the laces themselves.

In U.S. Pat. No. 6,601,323 the shoelaces are attached to the cover and then are secured by wrapping the ends of the cover to the back of the ankle.

Further, in U.S. Design Patent Nos. 369,237 and 356,675 the covers do attach to the laces but still flop around.

Lastly, U.S. Pat. No. 6,895,696, teaches a protective shoelace storage compartment incorporated within the tongue of the sports footwear, with the compartment being closed by a zipper or the hook loop fastening means.

Shoes with shoelaces are worn by millions of people worldwide. The distal ends of the laces are tied into a bow to keep the laces tightly secured about the shoe and thus secure the shoe onto the foot of the wearer. The problem encountered by many shoe wearers is the bow at the distal end of the laces becomes loose from abrasion or is not tied firmly enough or just gets loose and in the way. This is especially true of sports shoes worn for athletic endeavors like running, jumping, and skateboarding. The bows on the laces of the shoes of an individual, especially in any highly active sport, are prone to coming untied and become a danger to the shoe wearer. The athletic shoes that use a pile type fastening means instead of the laces do not tighten sufficiently, nor do they hold under the stress and abrasion created in any of the extreme activities of today's sports.

As such, there is a pressing need for a device that will allow the user of such shoes to lace them tightly and tie the distal ends in a bow and store the bow and distal end inside of a compartment. When enclosed in the compartment even under the high stress environment of modern sporting activities, the user is secure in the knowledge that the ties will not become entangled or undone, especially when participating in athletic activities which have a high chance of causing the laces to come free. In this regard, the present invention substantially fulfills this need.

SUMMARY OF THE INVENTION

The present invention provides shoelace accessory that captures and retains a tied shoelace. As such, the general purpose of the present invention will be described subsequently in greater detail.

The preferred embodiment of the invention is an accessory for shoelaces that secures the free ends of a shoelace. The accessory includes a member for encapsulating free ends of a shoelace. The member is formed of a semi-rigid to rigid material. The cross sectional view of the member shows that the member has a front wall and a rear wall, and a top part and a bottom par. Further, a pair of openings is positioned within the rear wall of the member. A slit is included; the slit extends a substantial length of the top part of the member. Lastly, a shoelace storage compartment is formed between the front wall, rear wall, bottom part and top part of the member. The shoelace storage compartment receives the free ends of the shoelace after one of each of the free ends has passed through the at least one of the pair of openings. The wearer of the accessory has access to the free ends of the shoe laces by way of the slit. This allows the user to pull the free ends through the pair of opening, tie the free ends and store them securely in the compartment.

In view of the forgoing disadvantages inherent in the known types of accessories for shoelaces now present in the prior art, the present invention provides an improved cover with a safety factor for the shoelace eyes and lace ends by completely encapsulating these loose ends to both sides of the shoe. As such, the general purpose of the present invention, which will be described subsequently in greater detail, is to provide a new and improved shoelace apparatus and method of use which has all the advantages of the prior art and none of the disadvantages.

To attain this, the present invention provides an accessory for shoelaces with two pieces, a left and right side for any shoe, which provide the same positioned apertures at the front end of each cover which accommodate the two lace ends so as to allow the lace ends to pass through the apertures and retain the cover to the laces. The shoe laces are then tied into a standard bow. The bow and the resulting tied shoelace end are both now folded inside the cover while a first attachment means, being a male part and a female part snap, are mated together thereby holding the bow and the tied shoelace end in place. The same scenario is provided for each side of the shoe. In this model the first attachment means is a male and female snap which are permanent attached to the cover. The back end of the cover has a second attachment means being the female side of the snap which is also permanently attached thereon the cover while the male end is permanently attached to the shoe itself.

This second attachment, female snap, attached to the cover mates together with the third attachment means, being the male snap on the shoe, thereby creating the attachment means for the cover to the shoe. Both sides of the shoe have the same cover arrangement and attachment means. The accessory has its own individual sequence of installation instructions and can be placed on any style shoe.

The present invention has an optional structure which comprises the exact same front end aperture means on the left and right side along with the same bow and tied shoelace end scenario. The cover in this option is made as a one piece construction, instead of two pieces. This option folds down into the shoe itself whereby the arch and weight of the person's foot holds this cover in place. A clip mean is not used in this model as the cover securing means. Instead, the first attachment means, the same as the two piece, is used to encapsulate the bow and tied shoelace end. One end fits on the left side, while the other end fits on the left side of any style shoe. This option also has its own individual sequence of installation instructions.

The common purpose of the aforementioned accessories is to provide a means to accept and retain the bow and tied shoelace end to both sides of a shoe, thereby providing a safety means so a person will not trip and fall because of untied loose shoelaces. The shoelace accessories prevent the shoelace from coming loose and thereby untied when the tied shoe lace in within the compartment of the accessory while it is attachable to any style shoe. The cover described in each model is made of a soft flexible material such as cloth, plastic or the like which may be colored coordinated to match any shoe such as a dress or a sports shoe such as a running shoe wherein the material may have a glow in the dark accent to help provide protection for runners. The shoelace accessory of the present invention succeed in providing an improvement over the prior art in this field. Further, an option in the present invention is for the manufacturer of the shoe to make the present shoelace accessory and add the accessory directly to their shoe line. There has thus been outlined, rather broadly, the shoe lace accessory of the invention in order that the detailed description thereof that follows may be better understood, and in order that the present contribution to the art may be better appreciated. There are, of course, additional features of the present invention that will be described hereinafter and which will form the subject matter of the claims appended hereto.

In this respect, before explaining at least one embodiment of the present invention in detail, it is to be understood that the present invention is not limited in its application to the details of construction and the arrangement of the components set forth in the following description or illustrated in the drawings. The invention is capable of other embodiments and of being practiced and carried out in various ways, also, it is to be fully understood that the phraseology and terminology employed herein are for the purpose of description and should not be regarded as limited.

As such, those skilled in the art will appreciate that the conception, upon which this disclosure is based, may readily be utilized as a basis for the designing of other structures, methods and systems for carrying out the several purpose of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the present application. The abstract is neither intended to define the invention of the application, which is measured by the claims, nor is it intended to be limited as to the scope of the present invention in any way.

It is therefore an object of the present invention to provide a new and improved accessory for a shoe which has the advantage of the prior art devises and none of the disadvantages.

It is another object of the present invention to provide a new and improved shoe accessory which may be easily and efficiently manufactured and marketed.

It is a further object of the present invention to provide a new and improved shoe accessory which is of a durable and reliable construction.

An even further object of the present invention is to provide a new and improved shoe accessory which is susceptible of a low cost of manufacture with regard to both materials and labor, and which accordingly is then susceptible of low prices of sale to the consuming public, thereby making such shoe accessories economically available to the buying public.

Still another object of the present invention is to provide a shoelace accessory device that improves the overall safety for wearers of laced shoes.

Still another object of the present invention is to provide a new and improved shoe accessory operable from a novice's level.

Yet another object of the present invention is to provide a new and improved system for storing the tied shoelace eyes and ends thereafter for security and safety.

Another object of the present invention is to provide a one-piece device that is safe for use during an athletic activity whether the user is a week-end athlete, amateur athlete or professional athlete.

These together with other objects of the present invention, along with the various features of novelty which characterize the present invention, are pointed out with a particularity in the claims annexed to and forming a part of this disclosure. For a better understanding of the present invention, its operating and installation advantages and the specific objects attained by its uses, reference should be had to the accompanying drawings and descriptive matter in which there are illustrated preferred embodiments of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 8:
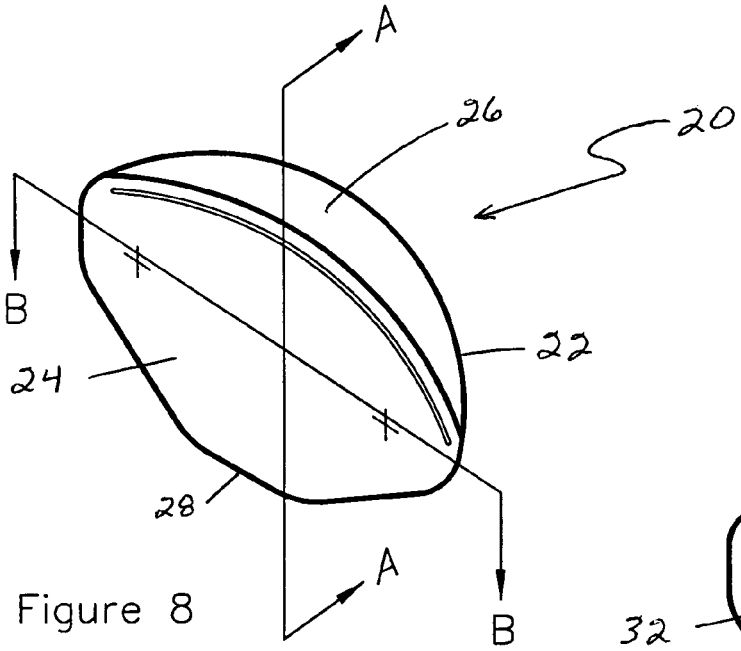
FIG. 8 is a rear perspective view of the preferred embodiment of the present invention.
Figure 18:
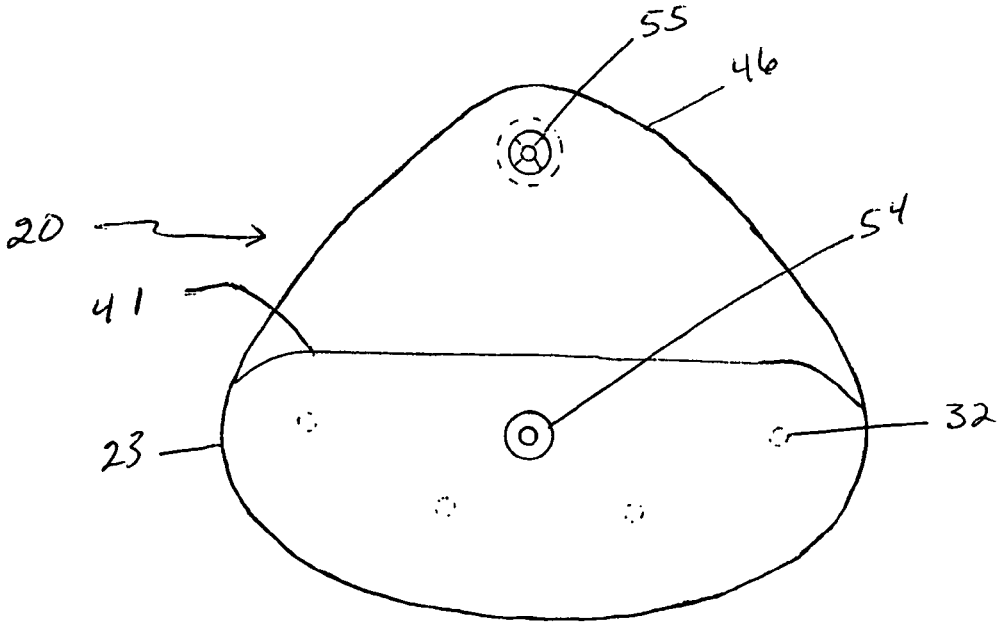
FIG. 18 is a frontal view of the embodiment of FIG. 17.

With reference now to the drawings, and in particular to FIGS. 8 and 18 thereof, an accessory for shoelaces embodying the principles and concepts of the present invention and generally designated by the reference numeral 20 will be described.

More specifically, the present invention includes a device which is a shoelace accessory used to secure the free ends of a shoelace. Generally, the shoelaces are tied after placement in the device, however, untied shoelaces can be secured within the device. The device has a member 20 that encapsulates the free ends of a shoelace. The member formed of a semi-rigid to rigid material, and when viewed in a cross section the member having a front wall 22 and a rear wall 24, a top part 26 and a bottom part 28. As shown in FIG. 8, the preferred shape of the member is crescent shaped or the shape of half of a walnut, with the rear wall being concave. The concave structure of the rear wall allows the device to be from fitted to the upper most part of the vamp of a shoe that is spaced from the toe box of the shoe. Note that if the shoe wearer laces the shoe such the laces are tied above that portion of the shoe vamp that is nearest the toe box the concave structure of the rear wall of the device will allow from fitting to the shoe. However, the device can be generally rectangular, cubic, pyramidal, cylindrical, triangular prism, diamond or half spherical in shape and remain functional.

Further, as depicted in FIGS. 8, 9, 12, 13, 15, and 16, a pair of openings 32 are positioned within the rear wall of the member 20. The openings are spherical or have the form of resilient flaps 34. No matter the shape of the pair of openings, they are sized to accommodate and range of shoe lace diameters. The preferred shape of for the pair of opening is that of the resilient flaps which includes angular end points for clasping a portion of the shoelace as the free end of one of the shoelace free ends is positioned therethrough to allow the free ends to enter into the shoelace storage compartment 40 for tying and storage of the tied free ends. The resilient flaps of the openings, when not in use come together at the intersecting of the x and y axis.

Figure 16:
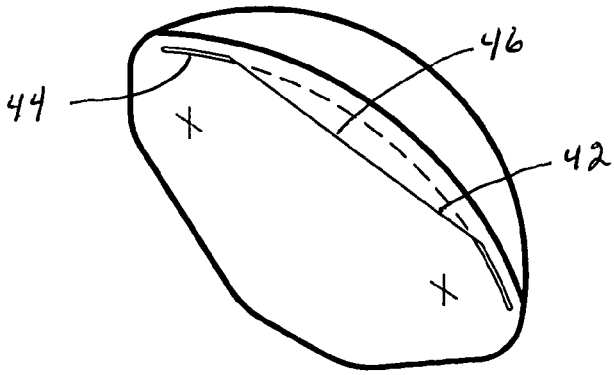
FIG. 16 is a rear view of the invention showing the flap formation at the slit.
Figure 17:
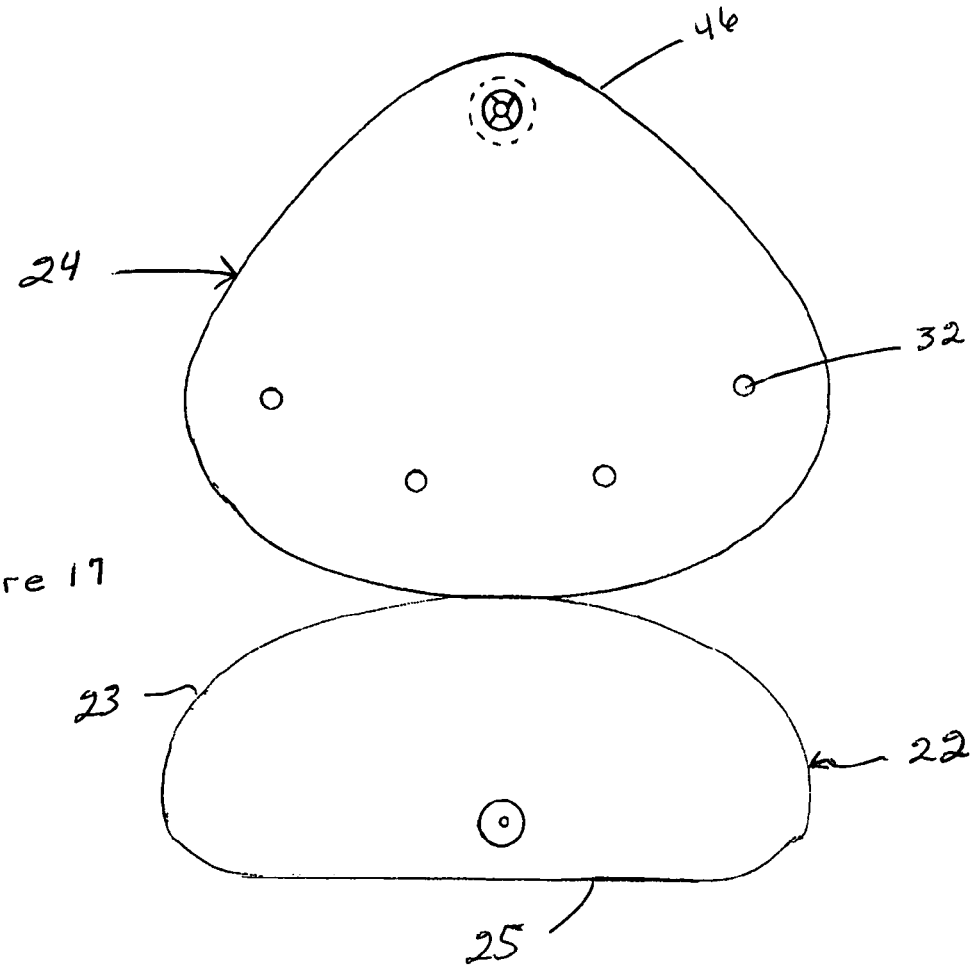
FIG. 17 is an open view of one embodiment of the present invention.

Along the top part of the device is a slit 38. Best shown in FIG. 15, the slit extends along the length of the top part 26 of the member. The slit allows the user to pull the free ends of the shoe laces through the pair of openings and tie the shoelaces. Once the shoelaces are tied, they are stored in the shoelace storage compartment 40 of the device. The shoelace storage compartment is formed between the front wall, rear wall, bottom part and top part of the member. The compartment receives the free ends of the shoelace after one of each of the free ends has passed through the at least one of the pair of openings. After the shoelace is tied is stored within the shoelace storage compartment and remains there until the user unties the shoe lace for removal of the shoe. Additionally, as shown in FIG. 16, the slit can have a first part 42 that is formed to act as a flap 46 that hangs over a second part 44 of the slit. The slit flap provides a resilient closing mechanism for the device that is highly useful when the user is engaged in very physical activities such, as playing sports.

Figure 9:
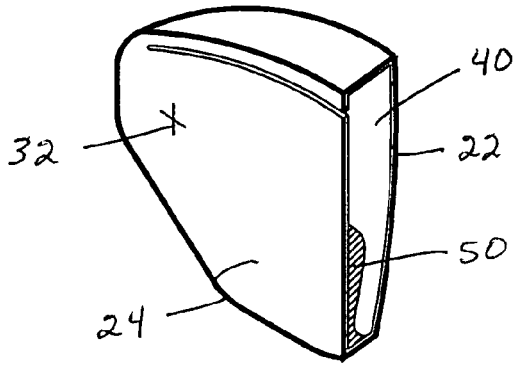
FIG. 9 is a cross sectional view of the present invention taken along lines A-A of FIG. 8.
Figure 10:
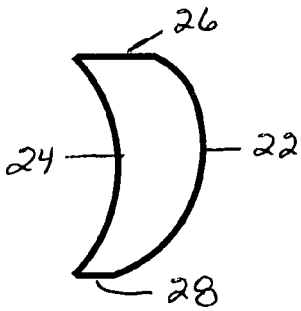
FIG. 10 is a right side view of the present invention of FIG. 8.
Figure 11:
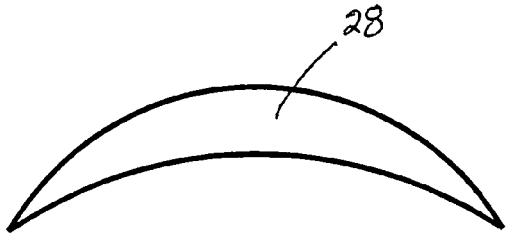
FIG. 11 is a bottom view of the present invention FIG. 8.
Figure 12:
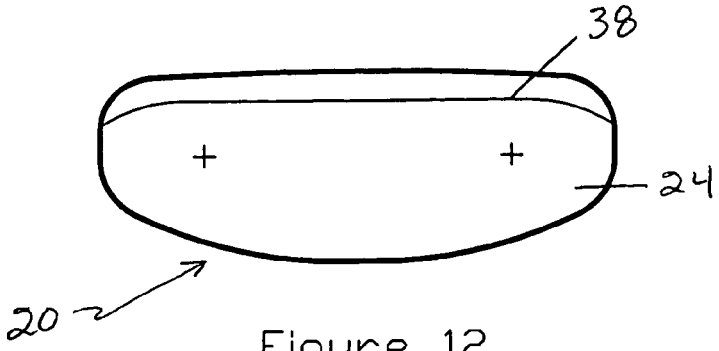
FIG. 12 is a rear view of the present invention of FIG. 8.
Figure 13:
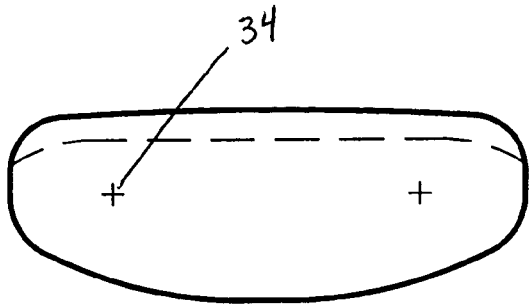
FIG. 13 is a frontal view of the present invention of FIG. 8.
Figure 14:
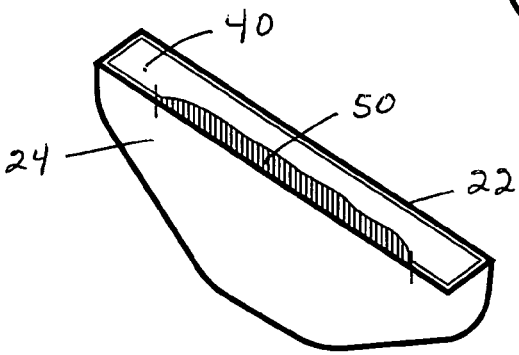
FIG. 14 is a longitudinal cross sectional view of the present invention taken along the lines B-B of FIG. 8.
Figure 15:
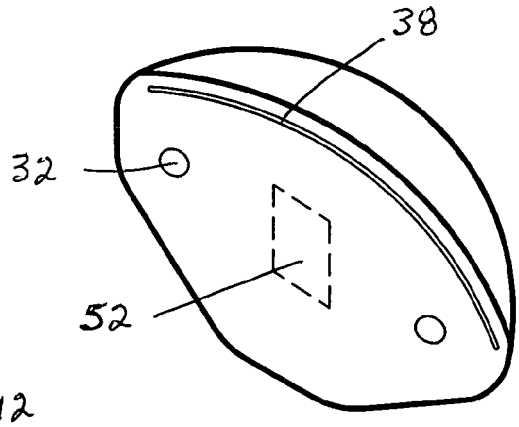
FIG. 15 is a perspective view of the present invention indicating the location of a tracking device.

In order to strengthen the area between the pair of openings the device includes a reinforcement area 50, as best shown in FIGS. 9 and 14, along the rear wall and centrally positioned between the pair of openings. As an added feature a wearable satellite tracking device 52, as outlined in FIG. 15, can be positioned within the reinforcement area or any other place within the wall of the member. The wearable satellite tracking device is designed to use a variety of radio waves which will allow it to receive and transmit. This means that it functions in via a wireless system used with cellular telephones, the internet and radio. The wearable satellite device is an additional safety feature that can be added and will be most useful for tracking the location of children.

Additionally, the member 20 of the device can for encapsulating free ends of a shoelace once tied, has the rear wall 24 is connected to the front wall 22 along the greater portion of a peripheral edge 23 of the front wall, with a smaller portion of the peripheral edge of the front wall being a free edge 25. The rear wall has a vertical length twice the vertical length of the front wall. Also, the free edge of the front wall has a length equal to the horizontal width of the rear wall. Further, the rear wall has a flap foldable onto the front wall.

The rear wall has at lease two openings 32 positioned therein. The rear wall can have a maximum of four opening in order to accommodate the width of the shoe the member is being used with. The openings are sized to receive the free ends of a shoelace prior to the shoe lace being tied.

A slit 46 is adjacent to and extends the length of the free edge 25 of the front wall. The slit allows the wear to access the shoelace storage compartment 40 of the member. The shoelace storage compartment is formed within the member between the front wall and the rear wall when greater portion of the peripheral edge of the front wall is connected to the rear wall 24. The shoelace storage compartment receives the free ends of the shoelace after one of each of the free ends has passed through at least one of the two openings. When the free ends of the shoelaces are tied after being passed through the two openings and are positioned within the shoelace storage compartment, the flap is folded. The folded flap is coupled to the front wall to secure the tied shoelaces within the shoelace storage compartment. A snap fastening system is used to ensure the flap remains coupled to the front wall. The snap fastening system includes a male snap portion 54 and female snap portion 55.

The accessory is made of a semi-rigid to rigid material that can be resilient thermoplastic elastomeric polymer or a synthetic rubber. While the composition of the semi-rigid to rigid material of the present invention is not particularly limited except by functional properties (it is preferably the consistency of a plastic or rubber hose), it is preferably a thermoplastic elastomer having a Shore A Hardness of from 25 to 98, more preferably from 40 to 80, as defined in the Handbook of Plastics, Elastomers, and Composites, Charles A. Harper, Second Ed. 1992, McGraw Hill, and particularly, Chapter 7 entitled "Thermoplastic Elastomers", and in Plastics Engineering Handbook of the Society of the Plastics Industry, Michael L. Berins, Fifth ed., 1991, pages 72 and 73. Examples of thermoplastic elastomers include thermoplastic polyurethanes, styrenic block copolymers, copolyesters, olefin blends, rubber olefin alloys, neoprene, ureaformaldehyde, polyvinyl-formaldehyde plastic, polyester resin reacted with aromatic diisocyanates to form a prepolymer which is then reacted with water to form a plastic urethane polymer, phenolformaldehyde resins, and polystyrene, or any other such natural or synthetic material known to those in the art with suitable properties such as resiliency, durability, good extrudability, and good appearance.

Preferably, the device is made from a synthetic rubber. More specifically, the device is made from Ethylene-propylene rubbers and elastomers (also called EPDM and EPM) with a Shore A hardness of from 30 to 95.

Both the thermoplastic elastomer and the synthetic rubber can be molded, either by blending and pouring manually the liquid reactive raw material in a mold or by using fully integrated casting equipment, spraying, dipping, Injection molding, extrusion and calendaring and blow molding.

Figure 1:
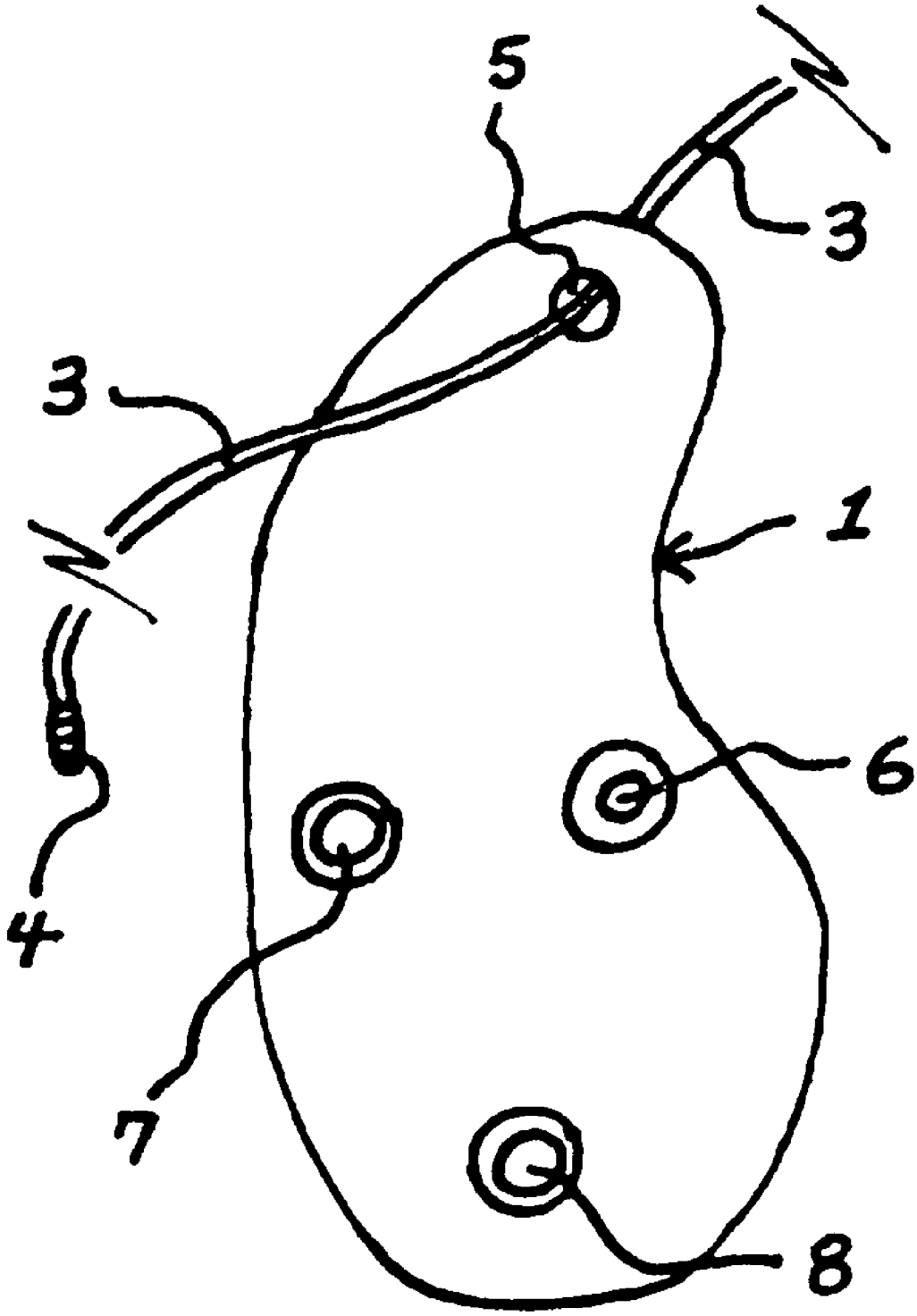
FIG. 1 is a drawing of the invention showing the left side cover.
Figure 2:
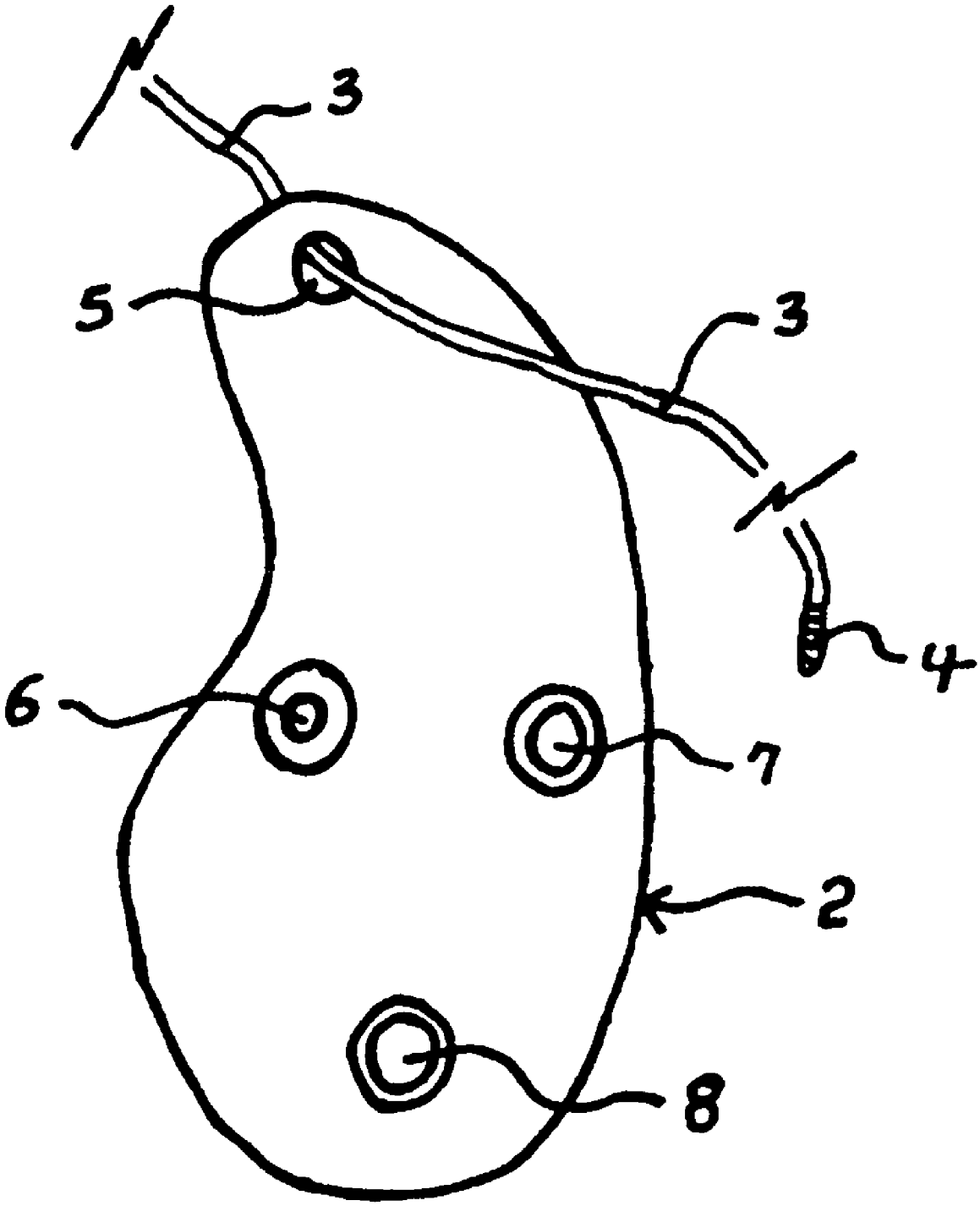
FIG. 2 is a drawing of the invention showing the right side cover.
Figure 3:
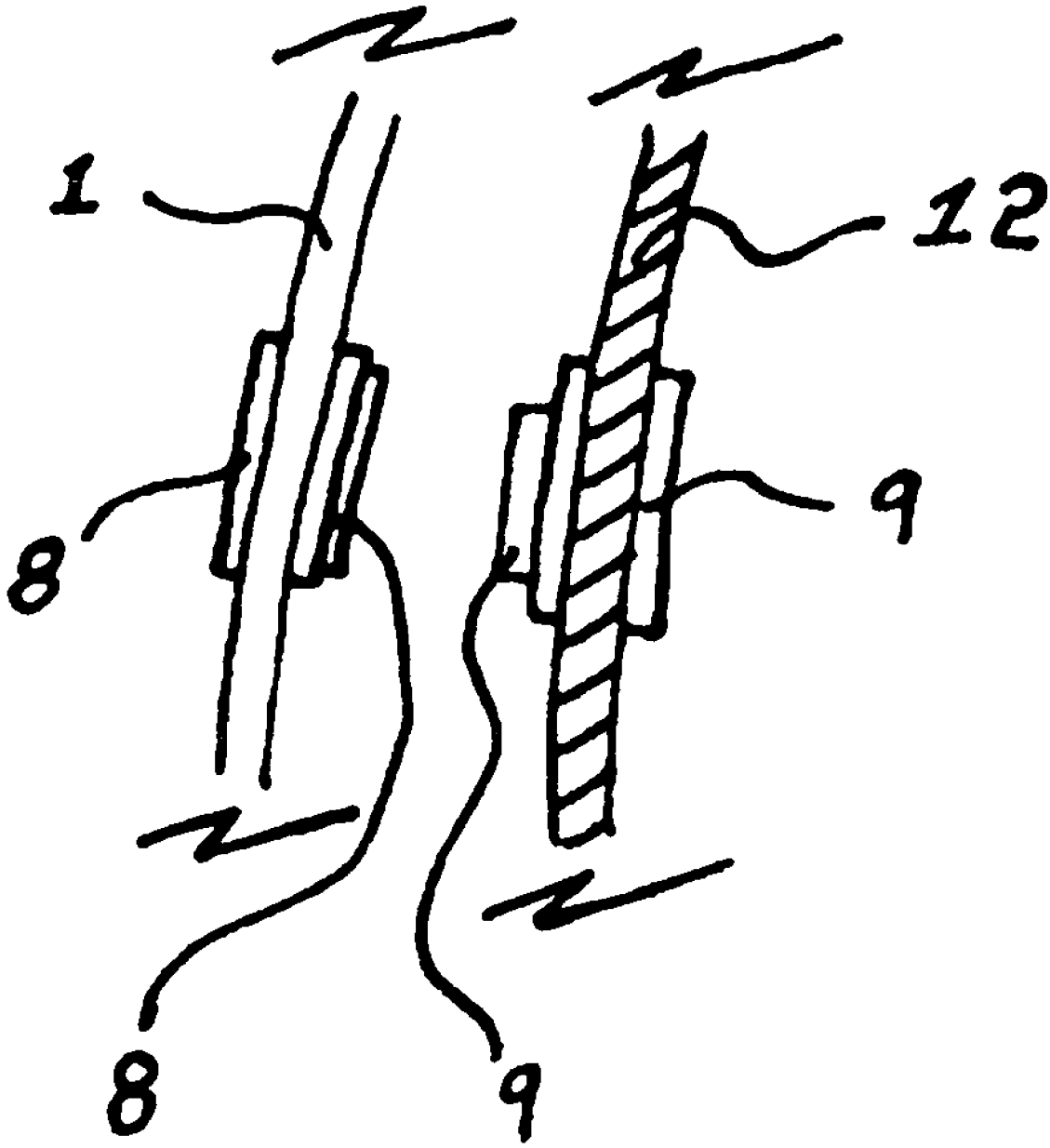
FIG. 3 is a detailed drawing of Model #1 showing the cover being attached by the snap means to the side of the shoe.
Figure 4:
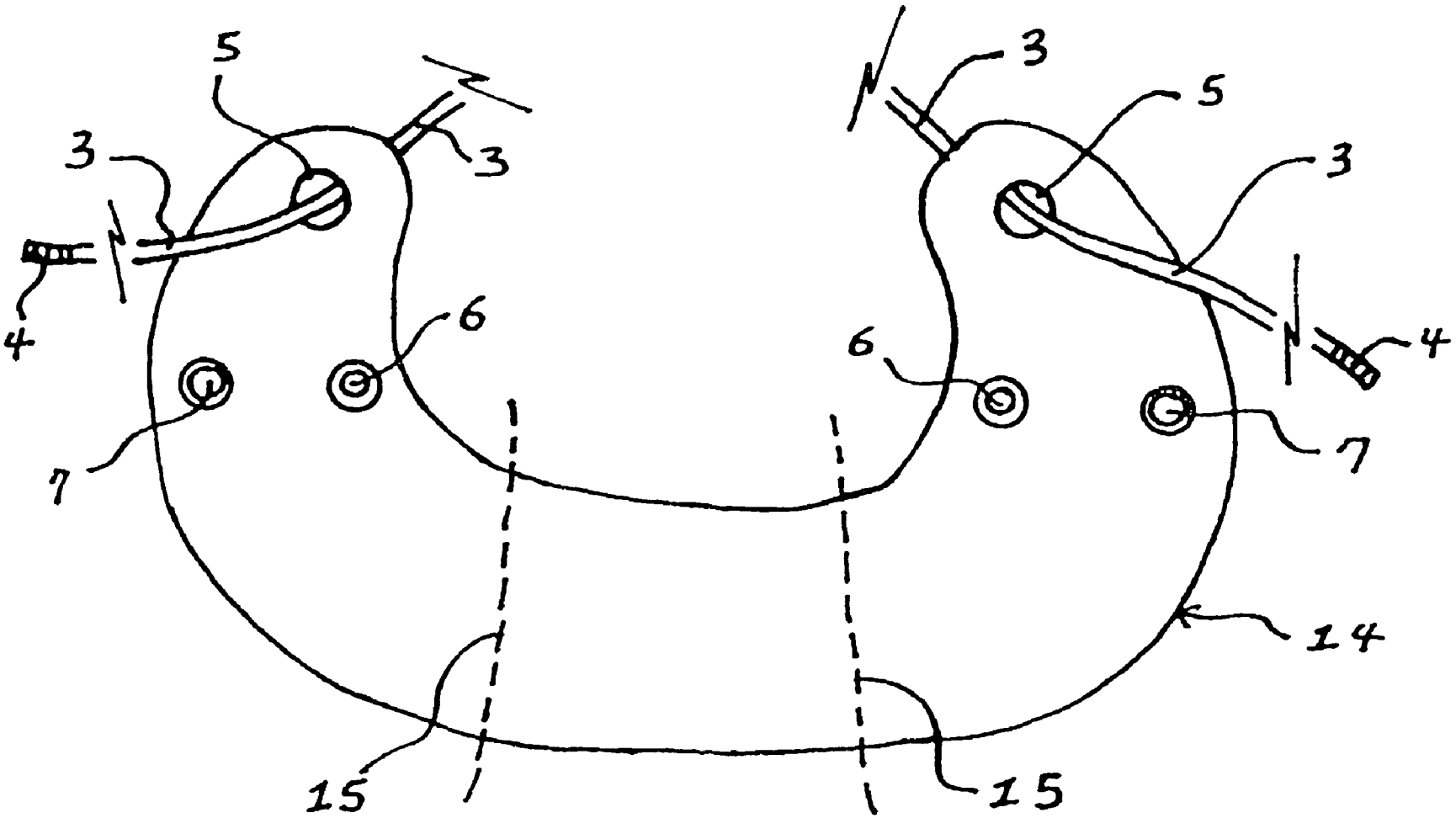
FIG. 4 is a drawing of the invention showing the one piece layout.
Figure 5:
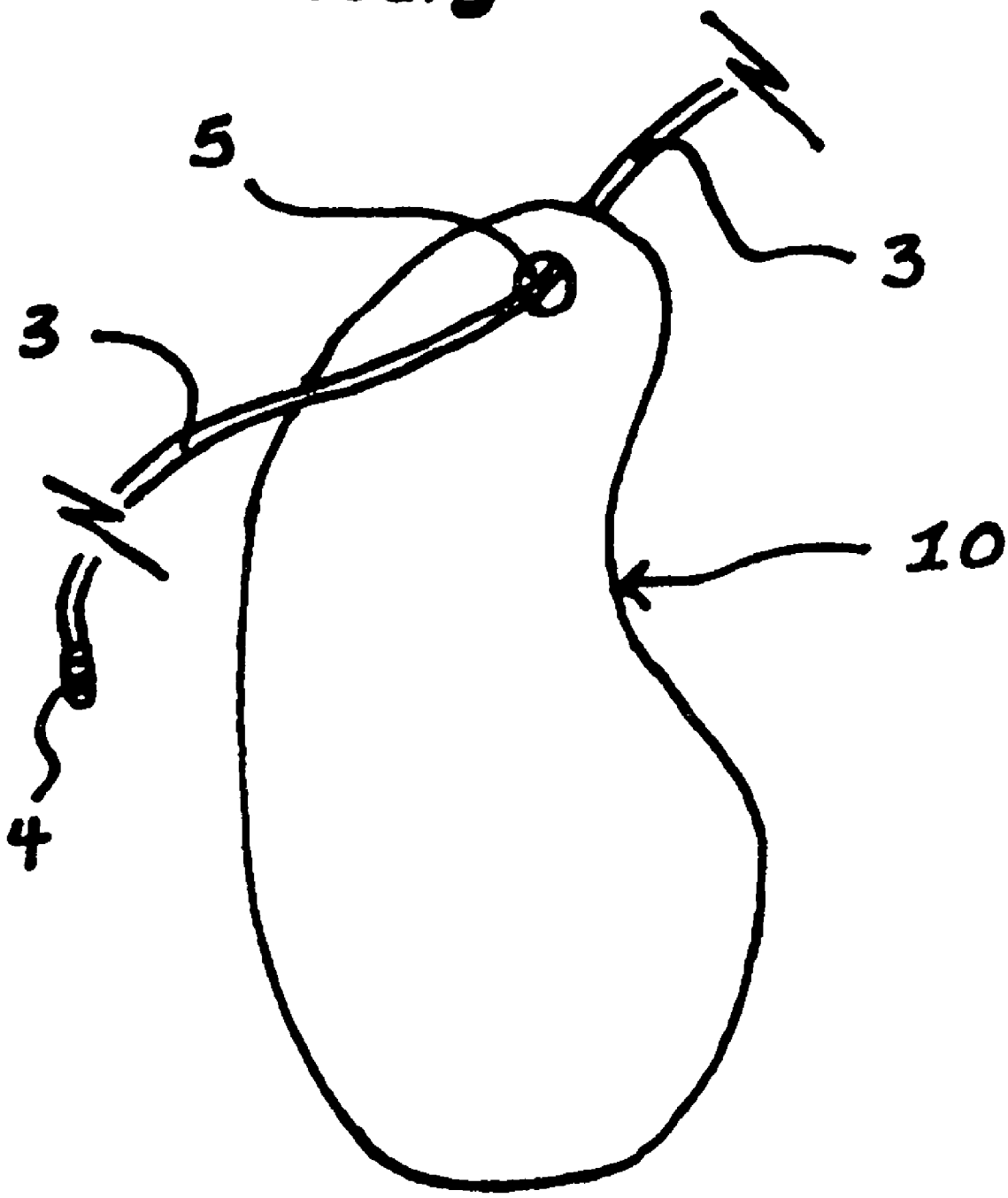
FIG. 5 is a drawing of the invention showing the left side cover of Model #2.
Figure 6:
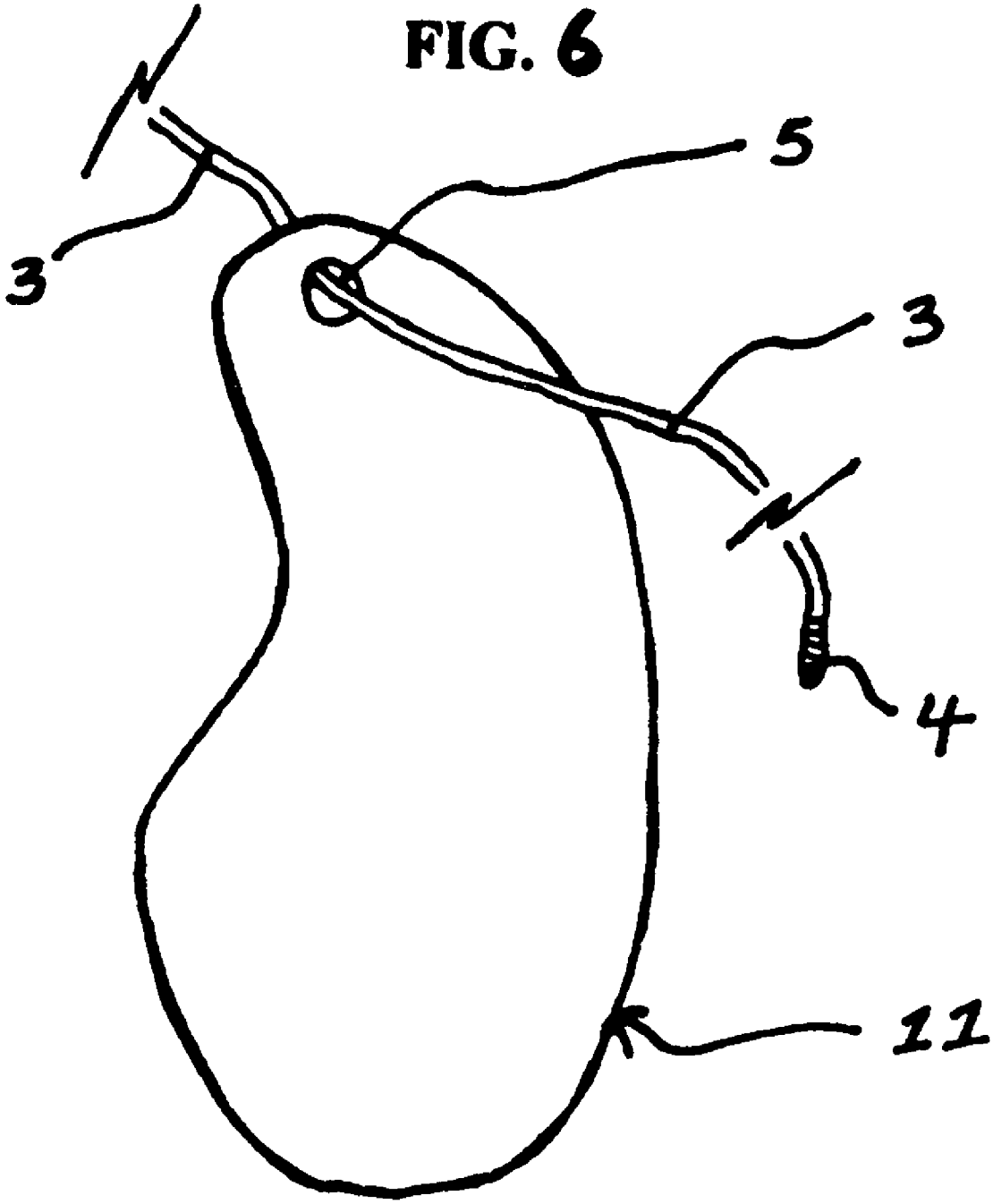
FIG. 6 is a drawing of the invention showing the right side cover of Model #2.
Figure 7:
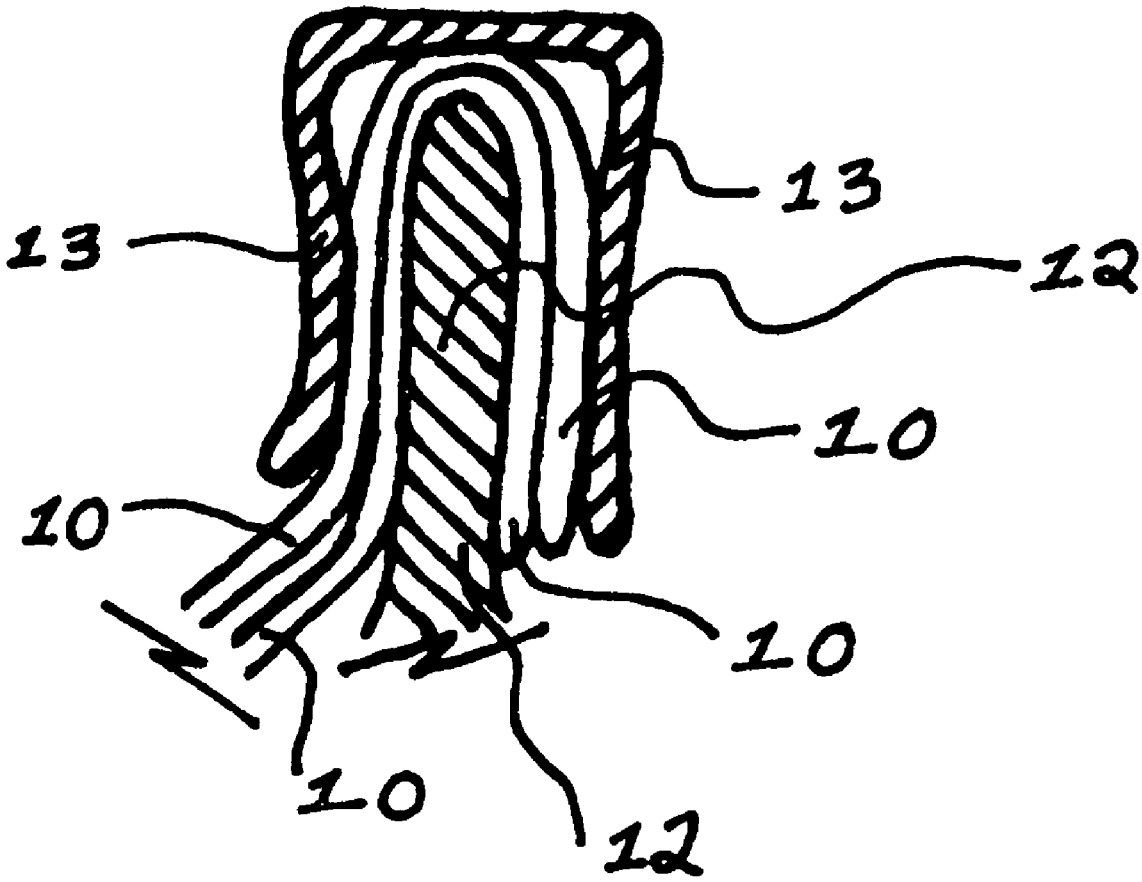
FIG. 7 is a drawing is a detailed drawing of Model #2 showing the cover being attached by the clip means of the side of the shoe.

In FIG. 1 left side cover 1 of accessory is shown with shoelace 3 and loose shoelace end 4 passing through aperture 5. Cover 1 is also shown with male snap 6 and female snap 7 which are snapped together thereby forming the finished attachment means for the left side cover 1 being used to fulfill the purpose of the present invention. Female snap 8 is shown at the opposite or bottom end of cover 1. FIG. 2 shows the right side cover 2 with shoelace 3 and loose shoelace end 4 passing through aperture 5. Cover 1 is also shown with male snap 6 and female snap 7 which also snap together thereby forming the finished attachment means for the right side cover 2. FIG. 3 shows the cover 1 with the female snap attachment means 8 attached there through cover 1 and aligned, so as to snap together, with male snap 9 which is attached to the side of shoe 12. FIG. 4 shows the optional accessory as a one piece constructed cover 14 with the wearer's foot 15 drawn in dotted lines so as to show the relationship of foot 15 to cover 14. The right and left side are shown with the same shoelace 3 and loose shoelace end 4 passing through aperture 5. Also shown is female snap means 7 with male snap means 6 on each side of cover 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, equitably entitled.

What is claimed is:

1. An accessory for receiving and securing the free ends of a shoelace, the accessory comprising:

a single one-piece member formed of a resilient thermoplastic polymer, the member having a front wall, a rear wall, and a periphery coupling the front and rear walls, the periphery including, opposed side parts, and a top part, and a bottom part, the front, and rear walls being concave with a center of curvature beneath the member when operatively positioned upon a shoe for receiving and securing a shoelace;

the front wall of the member being imperforate, the rear wall of the member having three openings, the openings including a pair of small openings and an elongated slit, the elongated slit extending across the rear wall adjacent to the top part of the member, the small openings being laterally spaced adjacent to the side parts and located beneath the elongated slit essentially midway between the top and bottom parts, the member comprising a shoelace storage compartment extending between the front wall, rear wall, side walls, bottom part and top part of the member, the compartment being of a size and shape for receiving and securing the free ends of a shoelace after one of each of the free ends has passed through a respective one of the pair of the small openings, the slit being formed with an upper edge and a lower edge normally positioned in facing contact with each other, the upper and lower edges adapted be separated by a user to provide access to the storage compartment and a shoelace therein.

* * * * *